United States Patent [19]

Price

[11] 4,317,319

[45] Mar. 2, 1982

[54] HEIGHT SENSING FOR BOX CLOSER

[76] Inventor: Douglas A. Price, 25 Bonacres Dr., West Hill, Ontario, Canada, M1C 1P6

[21] Appl. No.: 146,169

[22] Filed: May 2, 1980

[51] Int. Cl.[3] ..... B65B 57/00

[52] U.S. Cl. ..... 53/76; 53/374; 493/25

[58] Field of Search ..... 53/374, 76, 75; 493/14, 493/13, 10, 25

[56] References Cited

U.S. PATENT DOCUMENTS

| | | | |
|---|---|---|---|
| Re. 26,440 | 8/1968 | Loveland et al. | 53/75 |
| 3,045,402 | 7/1962 | Keely et al. | 53/75 UX |
| 3,085,376 | 4/1963 | Ferguson, Jr. et al. | 53/75 |
| 3,496,697 | 2/1970 | Loveland et al. | 53/76 |
| 3,502,256 | 3/1970 | Boulay et al. | 53/75 X |
| 3,769,777 | 11/1973 | Miller et al. | 53/76 |
| 3,894,380 | 7/1975 | Poulsen | 53/75 |
| 4,262,469 | 4/1981 | Ooms et al. | 53/76 |

*Primary Examiner*—James F. Coan

*Attorney, Agent, or Firm*—George A. Rolston; William F. Frank

[57] ABSTRACT

A random box closing apparatus of the type having a box closing and sealing station having a sealing head which is movable upwardly and downwardly to accommodate boxes of different heights and having a main conveyor adjustable for box width, and having a box sensing station for sensing the height of the box, and having a sensing conveyor adjustable for box width and for further sensing the width of the box, and thereby controlling the spacing of the main conveyor in the box closing and sealing station, in which the apparatus is characterized by height sensing means operable to sense the combined height both of the box and the upper closure flaps extending thereabove when open, and delivering a combined height signal responsive thereto, and movable carriage means upon which said height sensing means is movable upwardly and downwardly, at the box sensing station, and having signal communication means connecting between the height sensing means and the power operated movement means, whereby to move the box sealing head vertically responsive to such combined height signal and there being movement transmission means extending between the sealing head, and a portion of the sensing conveyor at the box sensing station and connecting with the height sensing means whereby to move the height sensing means vertically in response to a change in box width, and also moving the height sensing means vertically in response to vertical movement of the sealing head.

9 Claims, 7 Drawing Figures

HEIGHT SENSING FOR BOX CLOSER

The invention relates to machines for closing and sealing boxes.

It is highly desirable that box sealing machines shall be capable of accepting boxes of different sizes, and shall be capable of automatically adjusting themselves to the size of the box entering the machine. In this way boxes of different sizes, at random, may be passed along a conveyor belt to the sealing machine, without the need for an attendant at the sealing station to make adjustments in the machinery.

One particularly suitable form of such a sealing machine is disclosed in U.S. Pat. No. 3,894,380. In such a machine, the machine comprises a box sensing station, and a box closing and sealing station. Conveyors located at the sides of both stations are movable inwardly and outwardly to accomodate boxes of different widths. In the box closing station, a box sealing head for sealing the top flaps of the box, either by gluing, stapling, etc., is movable downwardly and upwardly to accomodate boxes of different height.

In the machine described in the aforesaid U.S. Patent, the box is first of all stopped in the box sensing station, and the conveyors, and a height sensor at that station then detect the width and height of the box.

Signals developed at the box sensing station then control movement of the conveyors, and box sealing head, in the box closing and sealing station.

As stated, each box in such a machine must be first of all stopped at the sensing station and checked, before it can then be re-started again and moved into the closing and sealing station.

While the delay involved is relatively small, not more than between one and two seconds per box, when this delay was added up to the time required for the remaining operations, it imposed undesirably low limitations on the rate at which boxes could be passed through the machine.

In this earlier machine, sensing of box width was accomplished at the box sensing station by movement of the side conveyors inwardly, into contact with the sides of the box. The conveyors in the box closing and sealing unit were then adjusted to the corresponding width.

Where the conveyors in the closing and sealing station were already at the same width, no adjustment was necessary. However, where they were at a different width, then of course they could not be adjusted until the box already in the closing and sealing station was clear of the conveyor.

This of course involved a certain delay, but it was unavoidable, and resulted from the feeding of boxes of different widths. Where a run of boxes of the same width are fed to the machine, then the delay for the width sensing of each box in unnecessary.

However, it was still necessary to sense the height of each box, and this involved delays, even where the boxes were of the same height and width. The problem is caused by the top flaps of the box.

When the box arrives at the box sensing station, the top flaps are open, i.e., they extend vertically upwardly above the box.

In order to seal the box it is necessary that the box sealing head shall be at the height of the box when closed.

Accordingly, in the earlier machine, a mechanical height sensing device was provided at the box sensing station which swung downwardly and folded one of the top closing flaps downwardly, and was thus able to read the height of the box when closed. It then sent the appropriate signal to the box sealing head. Where this was already at the correct height no adjustment was necessary. Nevertheless the mechanical height sensor caused a delay since it was necessary for it to swing downwardly to check the height of each box and then swing back upwardly.

For this purpose the box had to stop regardless of whether or not the conveyors, and sealing head were at the right location, in the closing and sealing station.

Clearly, where a run of boxes of identical size are being passed through the machine, then it is already going to be set up at the right position both width wise and for height, and the time delay required for mechanically checking the height of each box therefore is essentially wasted.

It is therefore clearly desirable to provide a random size box closer and sealer of the type described, which is capable of detecting boxes of the same size, and passing them through the box closing and sealing station without any delay. Even in the case of such a machine, it will still be necessary to stop boxes in the box sensing station, it they are of different sizes, so that the conveyors and box sealing head can be moved to the correct position in the box closing and sealing station. However, in practice it is found that the frequency with which boxes of the same size are passed to the machine is sufficiently high that it is reasonable to expect an increase in production of up to 50%, when such a continuous movement modification is used, as compared with the earlier machine.

As described, sensing of box width, and adjustment or non-adjustment of the side conveyors is already satisfactory and is already capable of detecting boxes of the same width, without stopping.

In order to speed up the height sensing, it is desirable to provide means for sensing the height of the box, which does not require the top closure flaps to be closed. Such a height sensing device will therefore have to sense the combined height of the box together with the added height of the box closing flaps. It will then have to send an appropriate signal to the box closing and sealing station to move the sealing head to the correct height of the box when closed.

In addition, such a height sensing device should also be capable of detecting boxes of the same height, while the boxes are moving through the box sensing station, and deliver an immediate "go" signal so that the box continues directly through to the box closing and sealing station without stopping provided the width sensing signal is also at "go".

Determining the true box height (i.e. the height of the box when closed) by sensing the combined box and flap height causes various problems. The flap height is one half the box width, but is independent of box height. Thus an increase in box width and a reduction in box height may produce no variation in combined box and flap height, although the true box height when closed is reduced.

Conversely an increase in box width alone will increase combined box and flap height due solely to the need to increase flap height, without any change having been made in the true box height when closed.

Thus such a height sensing unit must be responsive both to changes in combined box and flap height, and also to changes in box width (causing changes in flap height), in such a way as to give a correct reading of true box height at all times.

In order to overcome these problems and provide the foregoing advantages the invention comprises, in a random box closing apparatus of the type having a box closing and sealing station having a sealing head which is movable upwardly and downwardly by powered movement means to accomodate boxes of different heights and having main conveyor means adjustable for box width, and further having a box sensing station for sensing the height of the box, and having sensing conveyor means adjustable for box width and for further sensing the width of the box, and thereby controlling the spacing of the main conveyor means in the box closing and sealing station, and wherein the apparatus in characterized by remote height sensing means operable to sense the combined height both of the box and the upper closure flaps extending thereabove when open, and delivering a combined height signal responsive thereto, and movable carriage means upon which said height sensing means is movable upwardly and downwardly, at said box sensing station, and having signal communication means connecting between said remote height sensing means, and said power operated movement means, whereby to move said box sealing head upwardly or downwardly responsive to said combined height signal, and there being movement transmission means extending between a portion of said sensing conveyors at said box sensing station and connecting with said height sensing means whereby to move same downwardly in response to an increase in box width, and upwardly in response to a decrease in box width.

The invention further comprises such a machine in which there is movement transmission means connecting between said box sealing head and said height sensing means, whereby said height sensing means moves upwardly or downwardly in unison with upward and downward movement of said box sealing head.

The invention further comprises sensing only one half of the variation in box width, and adjusting the height sensing machines accordingly.

The various features of novelty which characterize the invention are pointed out in particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
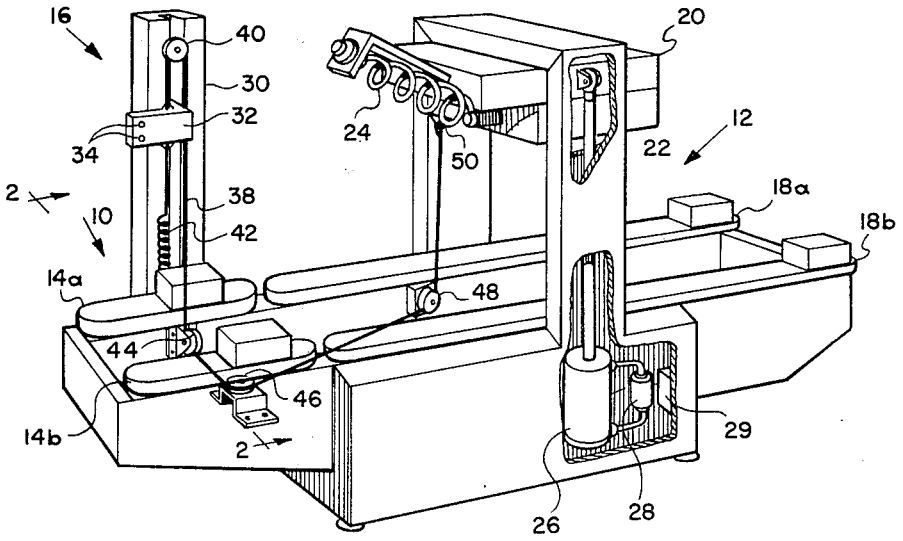
FIG. 1 is a schematic perspective illustration showing the box sealing and closing machine, with the height sensing unit according to the invention.
Figure 2:
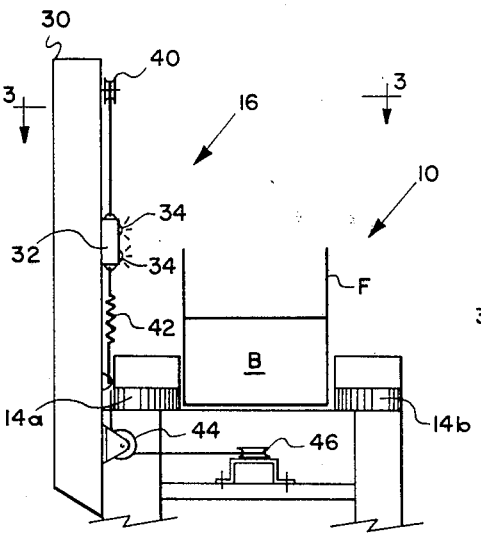
FIG. 2 is a schematic end view from the direction 2—2 of FIG. 1.
Figure 3:
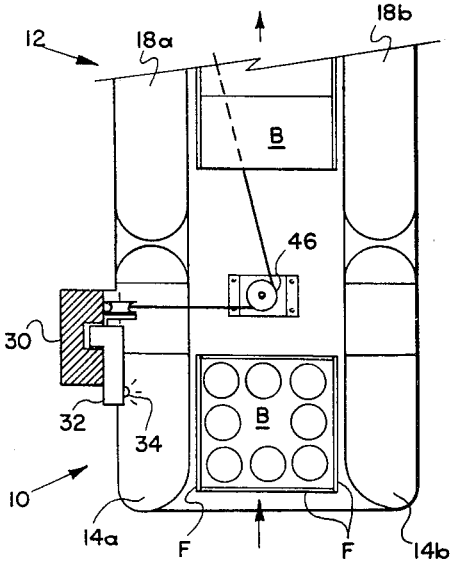
FIG. 3 is a schematic plan view, from the line 3—3 of FIG. 1.

Referring first of all to FIG. 1, the basic elements of the sealing and closing machine are essentially the same as that shown in U.S. Pat. No. 3,894,380. Thus the machine will be seen to comprise two basic stations namely a box sensing station 10, and a closing and sealing station 12. The sensing station 10 is provided with two side conveyor belts 14, which are movable towards and away from one another, so as to engage a box on its opposite vertical sides.

The underneath of the box is supported on a suitable system of free running rollers (not shown) such as are well known in the art.

In addition, suitable means will be provided for opening up the bottom side flaps of the box, while retaining the two bottom end flaps of the box closed, so that glue or other fastening means may be applied to the bottom flaps of the box, for closing and sealing the same. Again such support means are disclosed in the prior art, and form no part of the present invention.

On the side conveyor **14*a*, a height sensing unit indicated generally as 16** is provided, which will be described in greater detail hereinafter.

In the box closing and sealing station 12, two further side conveyors **18*a* and 18*b*** are provided, which are similarly mounted on movable carriage means whereby they may be moved towards and away from one another so as to engage the box on its opposite vertical sides. Again such movement means and carriage means are fully described in the aforesaid U.S. Letters Patent, and form no part of the present invention.

In addition, the box is supported on its underside by means of a suitable system of free running rollers such as are well known in the art. A lower glue applicator (not shown), or other fastening means is provided, for fastening the lower flaps and sealing them closed, as they pass through the station 12. Again such gluing means or other fastening means are well known in the art, and require no further description.

In order to close and seal the upper box flaps, an upper closing and sealing head 20 is provided, which is movable downwardly and upwardly, within frame 22. At its leading end head 19 carries a front and rear flap closer screw 24, and it further incorporates suitable glue applicator means (not shown) or other fastening means as are well known in the art and require no further description.

The upper sealing head 20 is movable upwardly and downwardly by any suitable movement means, although in this particular case it is found that a pneumatic cylinder 26 is particularly suitable for the purpose, cylinder 26 being a two-way cylinder, i.e. movable both upwardly and downwardly, and is operated under the control of valve 28, receiving pneumatic pressure from any suitable source and controlled by logic control 29.

In accordance with the method of operation described in the aforesaid U.S. Pat. No. 3,894,380, a box is first of all supplied to the box sensing station 10. The side conveyors **14*a* and 14*b* are opened up to their maximum extent, at this time. As the box enters the sensing station 10, by suitable automatic control means, the side conveyors 14***a* and 14*b* automatically close on the sides of the box, and engage it.

This function is carried out while a box is still passing through the box closing and sealing station 12.

By suitable control means, the width of the box in the sensing station 10 is sensed by the side conveyors 14*a* and 14*b*, while in motion and is converted into a signal. This signal is communicated to the carriage means for the side conveyors 18*a* and 18*b*, of the closing and sealing station 12. Where such side conveyors 18*a–b* are already at the same width as the side conveyors 14*a–b*, then no adjustment is required. Thus no change is required in order for the box passing through the sensing station 10, to enter directly into the closing and sealing station 12.

However, as mentioned, in the aforesaid earlier machine, the box in the sensing station 10 had to come to a halt, while the height was determined by the mechanical sensing arm. Where the true height of the box was the same as the previous box, then no movement of the closing and sealing head 20 was required, but nonetheless the box had to be stopped and started for height sensing to take place, in that machine.

In accordance with the present invention, this disadvantage is overcome by means of the improved height sensing unit 16.

The height sensing unit 16 will be seen to comprise a generally vertical support column 30 which is advantageously mounted on the side conveyor 14*a*, or the carriage on which it is movable inwardly and outwardly, and is in any event associated with the side conveyor 14*a* for the purpose of inward and outward movement.

A movable height sensing member 32 is slidably mounted on the support column 30 for vertical movement upwardly and downwardly. The height sensing member 32 is provided with two vertically spaced optical sensors 34. These may be of any of a variety of suitable designs of light sensitive devices, such as are well known in the art and are known generally as photocells.

Their function is to sense the upper edge of the top flaps of the box. This is achieved by generating two positive-negative signals, one from each sensor 34. Thus when the lower sensor 34 generates for example a positive signal, indicating sensing of the flap, and the upper sensor 34 generates a negative signal indicating no flap, then the sensor member 32 is at the correct height. If both signals for example are positive, then the sensor member 32 is too low. If both signals are negative, the sensor is too high. Obviously other combinations of signals could provide the same basic information.

The sensor member 32 is suitably guided by means of for example a channel 36 formed in the column, the sensor member 32 having a suitable guide member (not shown), received within channel 36 for the purpose.

In order to move the sensing member 32 upwardly and downwardly, it is mounted on a movement control means, in this case a cable 32, running over pulley 40, at the upper end of column 30. At the lower end of cable 38, any suitable biasing means is provided such as a spring 42 or simply a weight (not shown).

Cable 38 after running around pulley 40, extends downwardly once more along the column 30, and passes around a pulley 44 also mounted on the side conveyor 14*a* (or its movable carriage, not shown), so that the pulley 44 may move inwardly and outwardly along with movement of the side conveyor 14*a* and column 30.

The cable then passes around a fixed pulley 46, and then extends forwardly into the closing and sealing station 12, and passes around a further fixed pulley 48 and then extends upwardly within frame 22 and its free end is attached to the sealing head 20 as at fastening 50.

The cable and pulley system is merely one of several different ways of controlling and moving the sensing member 32. Other systems both mechanical and electrical and hydraulic or pneumatic may equally well be adapted for the purpose.

Signals from the optical sensors 34 are communicated by any suitable means such as wire 52, to the logic control 29.

As a result of the connection of cable 38, between the sensing member 32 and the sealing head 20, it will be seen that when the sealing head 20 is moved upwardly by operation of cylinder 26, the sensing member 32 will also move upwardly along column 30.

Conversely, when sealing head 20 is moved downwardly by cylinder 26, then the sensing member 32 will also move downwardly along column 30.

In addition to this movement of sensing member 32, which is directly responsive to movement of sealing head 20, the sensing member 32 is also movable upwardly and downwardly in response to inward and outward movement of side conveyor 14*a*.

It is particularly noteworthy that this movement is independent of upward and downward movement of sealing head 20

Thus when side conveyor 14*a* moves inwardly, the pulley 44 moves closer to the pulley 46, and consequently the cable 38 moves over pulley 40 in response to spring 42 and the sensing member 32 will move downwardly on column 30.

Conversely when the side conveyor 14*a* moves outwardly, the pulley 44 moves away from pulley 46, thereby causing sensing member 32 to move upwardly on column 30.

It will be seen that the sensing unit 32 is thus movable in response both to upward and downward movement of sealing unit 20 and also to horizontal transverse movement of side conveyor 14*a*. The cable 38 is the means whereby both such movements are sensed, and communicated to the sensing unit 32. It will be understood however that the sensing function, and the communication function, could be performed separately, or together, by a wide variety of different systems. Such systems might include for example optical sensors, or limit switches or the like for sensing the two movements. Movement of the sensing head 32 might be effected by a chain drive and electric motor, or some form of hydraulic or pneumatic drive.

Other systems will be readily apparent to those skilled in the art.

It is not intended to limit the scope of the invention to the use of any particular system for either function.

The operation of the height sensing unit according to the invention will now be described with reference to FIGS. 4, 5, 6 and 7.

Figure 4:
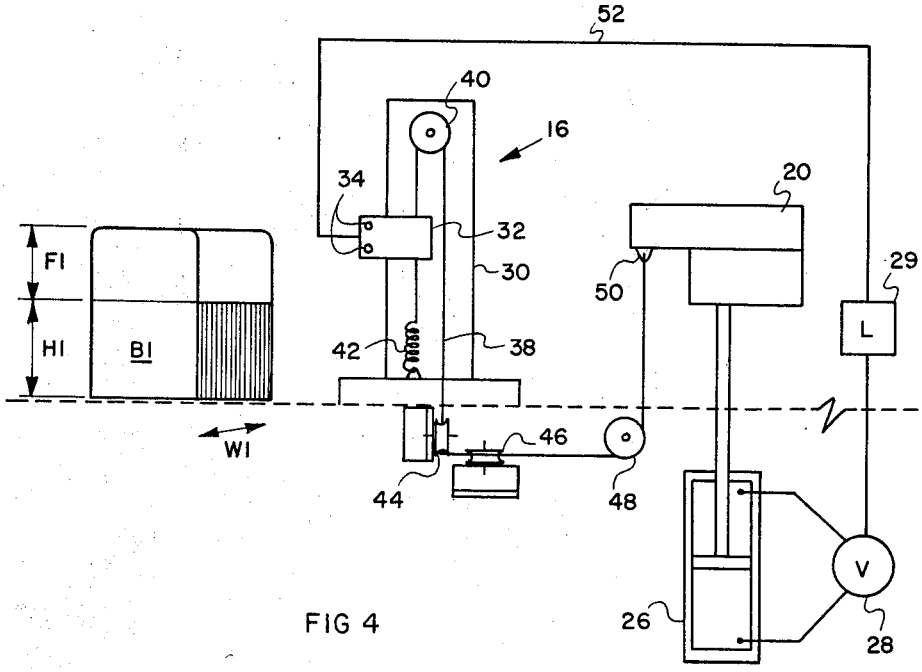
FIG. 4 is a schematic side elevation, showing the height sensing unit and closing and sealing head set up for a predetermined size of box and flap height.

As shown in FIG. 4, a more or less standard size box B1 is shown having flaps F1 extending upwardly therefrom. As explained above, side flaps F1 are equal to one half of the width of the box B1.

The box B is shown prior to entering the sensing station 10, for the sake of clarity only.

As shown in FIG. 4, assuming the box B1 is in fact in position in the sensing station 10. Box B1 has a true height H1, width W1 and flap width F1 (which is in fact W1/2). The sensing member 32 is shown at the correct height, for sensing the combined height of C1 of the edges of flaps F1, so that the upper optical sensor 34 is below the flaps F1. In this position, there will be a negative signal generated by the lower sensor and a positive signal generated by the upper sensor 34. It will of course be appreciated that it is irrelevant for the purposes of the invention whether the signal is positive or negative in either case, so long as they generate opposite signals, at the correct height.

Reference therefore to positive and negative is purely by way of explanation and is not regarded as limiting.

It will also be noted that the sealing head 20 is at the true box height H1 ready to receive the box. In order to achieve this matching between the sensing unit 32 and sealing head 20, the length of cable 38 is adjusted by any suitable means (not shown) such as is well known in the art, so that, with sealing head 20 at true box height H1, the sensing unit 32 is at the correct combined height C1, for sensing the edges of the flaps F1.

FIG. 4 thus shows the setting of the machine according to the invention, for use with a standard size of box. This standard size of box would normally be selected as being in the middle range of sizes of boxes that may be fed to the machine by a particular customer. It would normally be set up in this way by the manufacturer, prior to delivery to the customer. Normally no further adjustment would be necessary, unless the cable became stretched.

Figure 5:
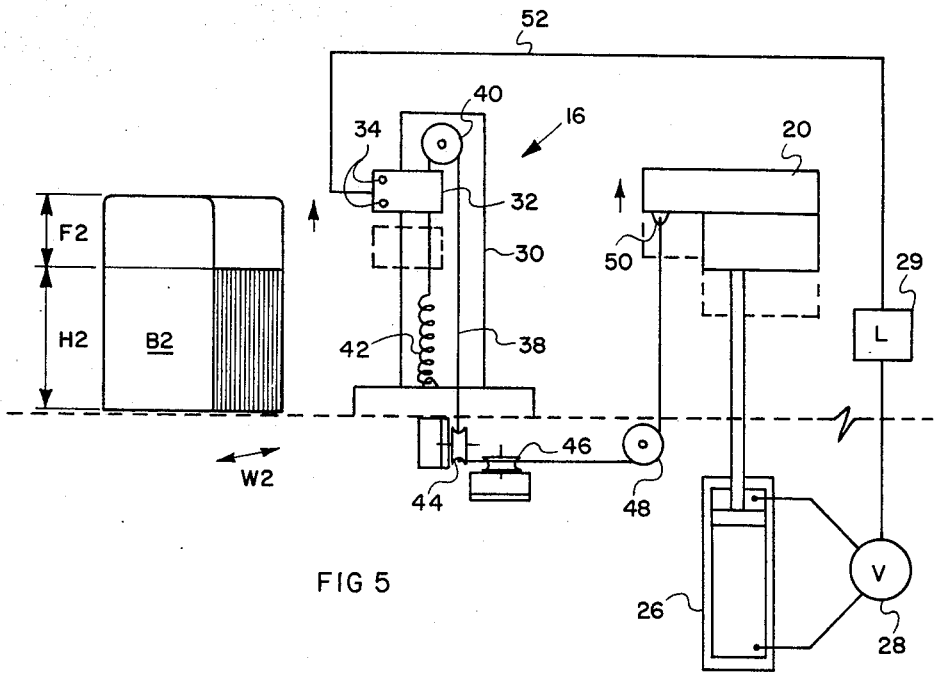
FIG. 5 is a schematic illustration corresponding to FIG. 4, showing the movement required for a box having a greater true height, but the same flap height.

FIG. 5 shows the condition of the machine for box B2 having a greater true height H2 and the same width W2 and therefore the same flap height F2. Although a box B2 has the same width as the box B1 of FIG. 4, the upper edges of the flaps are higher, at a combined height C2, when the box is open.

When the box B2 of FIG. 5 is supplied to the sensing station 10, the sensing member 32 will be below the edges of flaps F2. Consequently, the signals developed by the two opticl sensors 34 will both be the same, that is to say either both negative or both positive. On receipt of such signals in the logic control 29, a suitable control signal is then passed to the valve 28 so as to raise the sealing head 20 upwardly.

Upward movement of sealing head 20 as described above, will procure through the connection of cable 38, upward movement of sensing member 32 on column 30. As soon as the upper optical sensor 34 clears the top of the flap, the signals will then change so that they are different, with one negative and one positive. On receipt of such differing signals, the logic control 29 will then signal the valve 28 to close, and the sealing head 20 will then stop at the correct height, for the true height H2 of the box B2.

The combined height C3 will thus be lower than for box B2 of FIG. 5.

Figure 6:
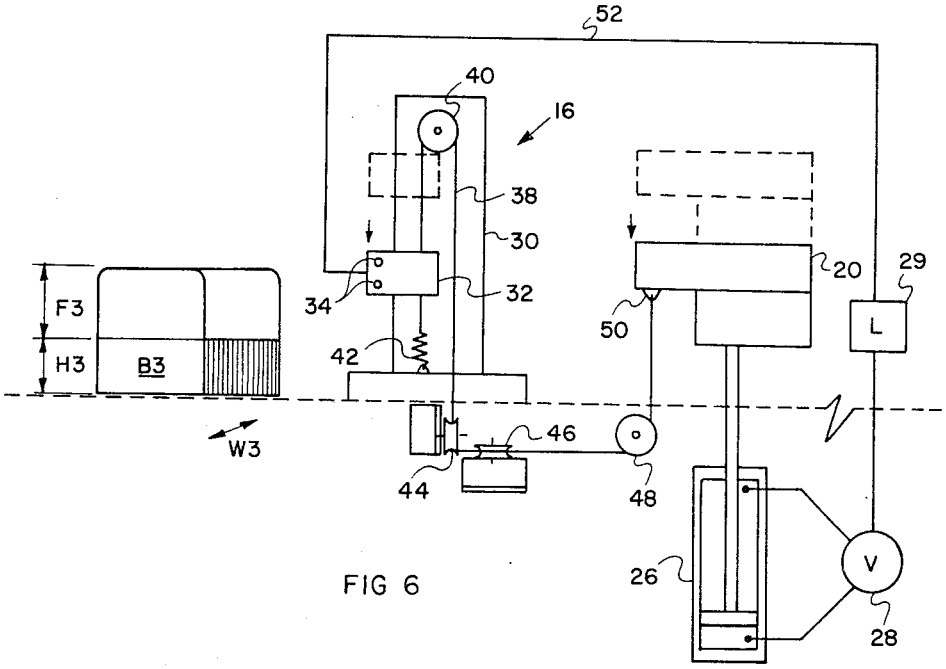
FIG. 6 is a schematic side elevation corresponding to FIG. 4, showing the movement required for a box having a lower true height, but the same flap height, and, FIG. 7 is a schematic illustration corresponding to FIG. 4, showing the movement required for a box having the same true height but a greater flap height (ie. a box which is wider, but has the same true height).

FIG. 6 illustrates the condition of the machine for a box B3 having a lesser true height H3, and width W3 and therefore the same flap height F3. In this case, the sensing member 32 will be above the edges of the flaps F3. In this case, the sensing member 32 will be above the edges of the flaps F3, and the signals from the two optical sensors 34 will both be the same, that is to say either positive or negative. On receipt of such signals, the logic control 29 will then signal the valve 28 to operate the cylinder 22 so as to move the sealing head 20 downwardly. Downward movement of the sealing head 20 will be communicated via cable 38 to the sensing member 32 and move it downwardly, the spring or other biasing means 40 pulling the member 32 downwardly, as the cable 38 is released by downward movement of the sealing head 20.

As soon as the lower optical sensor 34 passes the edge of the flap F3, the signals will then change, and the logic control 29 will then close the valve 28.

Figure 7:
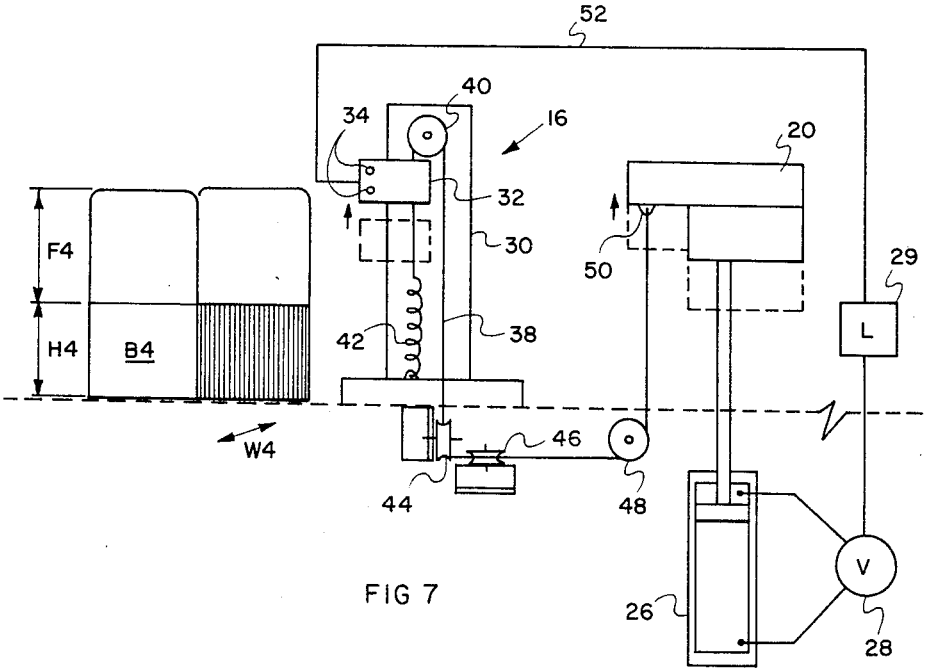

FIG. 7 illustrates the condition for a box B4 having the same true height H4 but a greater width W4 than the width of the box of FIG. 4.

In this case, the flap height F4 is greater than the flap height F1 of the box B1 of FIG. 4, since the box B4 is wider.

The flap height F4 will be greater by an amount equal to one-half of the increase in width W4 of the box.

In this condition, when the box B4 enters the sensing station 10, the sensing member 32 will be below the edges of the flaps F4, but the sealing head 20 wll be at the correct true height H4, and must not move.

Since the width W4 is greater, the side conveyors **14*a* and 14*b* will move from their outermost position, until they contact the opposite sides of the box B4. This position will be somewhat further apart, than in the case of the box B1 of FIG. 4**.

Because of this, the pulley 44 will be somewhat further away from the pulley 46, thereby shortening the cable 38, and causing the sensing member 32 to arrive at a somewhat higher position, when the side conveyors **14*a* and 14*b*** finally close on the sides of the box.

It will be noed that this difference in spacing between the pulleys 44 and 46 is equal to one-half of the increase in the width of the box. Thus the difference in spacing between the pulleys 44 and 46 is equal to the difference in flap height between the box B1 of FIG. 4 and box B4 of FIG. 7. It thus follows that the sensor member 32 will be in the correct position to sense the upper edge of the flaps. Thus the signals from the optical sensors 34 will be different, that is to say one positive and one negative. Consequently the logic 26 will send no signals to the valve 24, and the cylinder 22 will not be operated. The sealing head 20 will thus remain at the same height.

As explained above, the condition of FIGS. 5, 6 and 7 will obtain where boxes of either different height or different width, or both, are supplied to sensing station 10. In all such cases, the box will be halted in the sensing station 10, since all such conditions some movement either of the sealing head 20 or of the side conveyors **18*a* and 18*b* in the closing and sealing station 12 will be necessary. Clearly, such movement cannot take place until the box presently in the closing and sealing station 12** has been cleared.

However, where a run of the same boxes as are shown in FIG. 4 are supplied to the sensing station 10, then the sensing station 10 will detect both the same width and the same height. In this case, no adjustment whatever is necessary in the closing and sealing station 12. Accordingly, it is no longer necessary to stop the box in the sensing station 10.

The box in the sensing station can then be fed directly into the closing and sealing station 12, thereby greatly speeding up the operation of the machine.

As mentioned above, experience indicates that by setting up the machine to accommodate the commonest size of box used in any particular plant, an increase in production of up to 50% can be achieved, using the present invention, since the probability of runs of two or more boxes of the same width and height being supplied to the machine one after the other, is quite significant.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. In a random box closing apparatus of the type having a box closing and sealing station having a sealing head which is movable upwardly and downwardly by powered movement means to accommodate boxes of different heights and having a main conveyor means adjustable for box width, and further having a box sensing station for sensing the height of the box, and having sensing conveyor means adjustable for box width and for further sensing the width of the box, and thereby controlling the spacing of the main conveyor means in the box closing and sealing station, and wherein the apparatus is characterized by;

height sensing means operable to sense the combined height both of the box and the upper closure flaps extending thereabove when open, and delivering a combined height signal responsive thereto;

movable carriage means upon which said height sensing means is movable upwardly and downwardly, at said box sensing station;

signal communication means connecting between said height sensing means, and said powered movement means, whereby to move said box sealing head vertically responsive to said combined height signal, and, movement transmission means extending between said sealing head and a portion of said sensing conveyor means at said box sensing station and connecting with said height sensing means whereby to move said height sensing means vertically in response to a change in box width, and also moving said height sensing means vertically in response to vertical movement of said sealing head by said powered movement means.

2. Apparatus as claimed in claim 1 wherein said remote height sensing means comprises a vertical support member, and photosensitive sensing means operable to sense the upper edge of the box closure flap, and responsive thereto to deliver a height sensing signal.

3. Apparatus as claimed in claim 2 wherein said movable carriage means is movably mounted on said vertical support member, for movement between upper and lower positions thereon, and wherein said vertical support member is movable laterally relative to the path of movement of a box in said box sensing station.

4. Apparatus as claimed in claim 3 wherein said movement transmission means comprises a pulley member at an upper end of said vertical support member, and a flexible cord means extending around said pulley member, and hanging downwardly therefrom on either side thereof forming two cord portions, and wherein said moveable carriage means is supported on a first said cord portion.

5. Apparatus as claimed in claim 4 wherein a second said pulley member is located in registration with a lower portion of said vertical support member, and wherein said second cord portion extends downwardly around said second pulley and including a third said pulley member located laterally inwardly of said second pulley member, said second cord portion extending around said third pulley member, and connecting with said sealing head.

6. Apparatus as claimed in claim 5 wherein said vertical support member is mounted on a portion of said sensing conveyor means at said box sensing station, and is movable laterally in conjunction therewith relative to said third pulley member, such lateral movement thereby varying the spacing between said second pulley member and said third pulley member.

7. Apparatus as claimed in claim 6 including a fourth said pulley member located at said box closing and sealing station, with said flexible core means extending from said third pulley member around said fourth pulley member, and upwardly into connection with said box sealing head, whereby vertical movement of said box sealing head will be communicated by said flexible cord means to said movement carriage means.

8. Apparatus as claimed in claim 7 including biassing means at the free end of said first cord portion applying a biassing force thereto maintaining tension on said flexible cord means, said biassing means yielding to permit movement of said flexible cord means in one direction, and retracting said flexible cord means upon movement in the other direction.

9. Apparatus as claimed in claim 1 wherein said height sensing means is movable upwardly, in response to an upward movement of said sealing head and downwardly in response to a downward movement of said sealing head, and wherein said height sensing means is movable upwardly in response to an increase in box width and downwardly in response to a decrease in box width.

* * * * *